US010376012B2

(12) United States Patent
Sakemiller

(10) Patent No.: US 10,376,012 B2
(45) Date of Patent: Aug. 13, 2019

(54) SAFETY HELMET WITH RETRACTABLE BRIM

(71) Applicant: Jill Sakemiller, Hallandale, FL (US)

(72) Inventor: Jill Sakemiller, Hallandale, FL (US)

( * ) Notice: Subject to any disclaimer, the term of this patent is extended or adjusted under 35 U.S.C. 154(b) by 185 days.

(21) Appl. No.: 15/158,273

(22) Filed: May 18, 2016

(65) Prior Publication Data

US 2017/0265558 A1 Sep. 21, 2017

Related U.S. Application Data

(60) Provisional application No. 62/162,950, filed on May 18, 2015.

(51) Int. Cl.
*A42B 3/06* (2006.01)
*A42B 3/22* (2006.01)

(52) U.S. Cl.
CPC ..... *A42B 3/223* (2013.01); *A42B 3/066* (2013.01); *A42B 3/22* (2013.01); *A42B 3/221* (2013.01); *A42B 3/227* (2013.01)

(58) Field of Classification Search
CPC ..... A61F 9/025; G02C 3/02; A42B 3/223; A42B 3/066; A42B 3/227; A42B 3/222; A42B 3/22; A42B 3/225; A42B 3/185; A42B 1/247; A42B 1/062; A42B 1/065; A42B 1/064
USPC ..... 2/10, 15, 195.1, 424, 453, 454, 6.5, 2/209.12
See application file for complete search history.

(56) References Cited

U.S. PATENT DOCUMENTS 3,837,005 A * 9/1974 Persson ..... A42B 3/22 2/10
4,777,667 A * 10/1988 Patterson ..... A42B 1/064 2/195.5
5,197,150 A 3/1993 Bedient
5,448,780 A 9/1995 Gath
5,669,071 A * 9/1997 Vu ..... A42B 1/247 2/10
5,689,830 A 11/1997 Pflum
5,815,832 A * 10/1998 Skolik ..... A42B 1/247 2/10
6,282,726 B1 * 9/2001 Noyerie ..... A42B 3/226 2/424
6,959,989 B2 * 11/2005 Holm ..... A42B 3/185 2/10

(Continued)

*Primary Examiner* — Jameson D Collier
*Assistant Examiner* — Jocelyn Bravo

(57) ABSTRACT

A safety helmet with retractable brim comprising a helmet shaped body having a slot presented on a downward facing surface of a front section. The safety helmet includes a brim that translates within the slot between a retracted and a downward configuration. In the retracted configuration the brim is received within the slot. In the downward configuration the second end of the brim does not extend beyond the forward facing surface of the helmet. A pivoting element is configured to pivotally couple the brim proximate to the lip of the slot. The pivoting element allows the brim to move between the downward configuration and a forward configuration. In the forward configuration the brim extends outward beyond a forward facing surface of the helmet shaped body. A first locking element is configured to maintain the brim in the forward configuration.

20 Claims, 8 Drawing Sheets

(56) References Cited

U.S. PATENT DOCUMENTS

| | | | | |
|---|---|---|---|---|
| 7,240,374 | B2 * | 7/2007 | Fang | A42B 1/247 2/10 |
| 2004/0010832 | A1 | 1/2004 | Witkoff | |
| 2005/0039240 | A1 * | 2/2005 | Kidouchim | A61F 9/04 2/10 |
| 2005/0078273 | A1 * | 4/2005 | Holm | A42B 3/185 351/155 |
| 2010/0229288 | A1 * | 9/2010 | Higgins | A42B 3/185 2/422 |
| 2012/0110718 | A1 | 5/2012 | Kim | |
| 2014/0345037 | A1 * | 11/2014 | McKinney | A42B 3/227 2/424 |

* cited by examiner

SAFETY HELMET WITH RETRACTABLE BRIM

CROSS-REFERENCE TO RELATED APPLICATIONS

This application claims the benefit of the filing date of U.S. Provisional Application Ser. No. 62/162,950 titled "Retractable Visor" and filed May 18, 2015 and the subject matter of which is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of safety helmets, and more specially, to the field of apparatus used with safety helmets for providing protection from the sun's rays.

BACKGROUND

Bicycling is a major industry in the United States and throughout the world. In the United States alone, the number of people who have been cycling within the last 12 months amounted to 47.16 million. The U.S. bicycle industry is a 6.1 billion industry annually. Each year about 2 percent of motor vehicle crash deaths are bicyclists. In a majority of bicyclist deaths, the most serious injuries are to the head, highlighting the importance of wearing a bicycle helmet. Helmet use has been estimated to reduce head injury risk by 85 percent.

However, conventional bike helmets do not provide the bicyclist with protection from the sun's rays, precipitation, or other environmental hazards. As a result, the bicyclist may have a difficult time seeing while riding his or her bike due to the brightness of the sun. Further, while it is raining, the bicyclist may have difficulty seeing due to rain hitting the bicyclist's eyes and face.

While some people choose to wear a baseball hat underneath a helmet, this arrangement can be awkward and the brim of the hat may not be able to be positioned in the desired manner. Some existing prior art has attempted to solve this problem. However, the existing prior art has several disadvantages.

For example, U.S. Pat. No. 5,448,780 discloses a safety helmet with a shield. However, U.S. Pat. No. 5,448,780 fails to address an adequate means of dealing with glare and does not provide a brim. U.S. Pat. No. 6,687,909 discloses a sun visor for a safety helmet. However, U.S. Pat. No. 6,687,909 must be completely removed if it is not sunny and therefore is not time efficient and cumbersome.

U.S. Pat. No. 5,689,830 provides a hat that discloses a telescoping brim. However, U.S. Pat. No. 5,689,830 fails to disclose a means for retracting the brim completely without having to remove the brim. As a result, there exists a need for improvements over the prior art and more particularly for a more efficient way of allowing providing a safety helmet with a brim.

SUMMARY

A safety helmet with retractable brim is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a safety helmet with retractable brim is disclosed. The safety helmet comprises a helmet shaped body configured for being worn on a wearer's head and to expose a wearer's face. A slot having a lip is presented on a downward facing surface or receiving surface of a front section of the helmet shaped body. The safety helmet includes a brim, having a first end opposing a second end. The brim is configured to translate linearly within the slot between a retracted configuration and a downward configuration. In the retracted configuration at least a substantial portion of the brim is configured to be received within the slot. In the downward configuration the brim is configured such that the second end of the brim is proximate to the downward facing surface and the first end of the brim does not extend beyond the forward facing surface of the helmet. A pivoting element is configured to pivotally couple the second end of the brim proximate to the lip of the slot when the brim is not in the retracted configuration. The pivoting element is configured to allow the brim to move between the downward configuration and a forward configuration. In the forward configuration the brim is configured such that the second end of the brim is proximate to the downward facing surface or receiving surface and the first end of the brim extends outward beyond a forward facing surface of the helmet shaped body. A first locking element is configured to maintain the brim in the forward configuration.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1A:
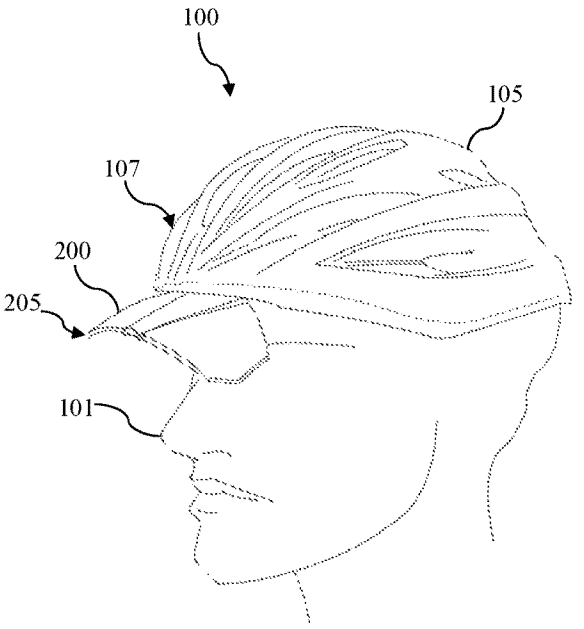
FIG. 1A is a perspective view of an illustration of the safety helmet 100 worn by a user 101, wherein a brim of the safety helmet is in a forward configuration, according to an example non-limiting embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a safety helmet with a retractable brim. The present invention improves over the prior art by providing a brim or visor that can be easily extended and retracted into the helmet shaped body. The present invention improves over prior art by providing a helmet with a retractable brim, which such retractable brim can be retracted so that the brim is completely sheathed or retracted and does not affect the aerodynamics of the helmet. Additionally, the retractable brim also provides a means for having a brim or visor that does not affect a rider's vision at night.

Figure 1B:
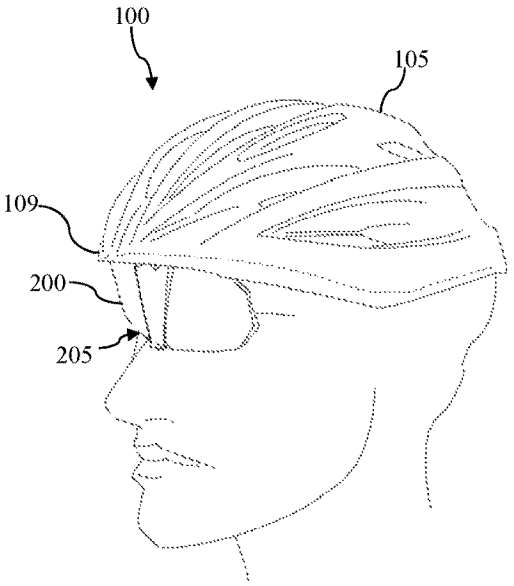
FIG. 1B is a perspective view of an illustration of the safety helmet worn by a user, wherein a brim of the safety helmet is in a downward configuration, according to an example non-limiting embodiment.
Figure 1C:
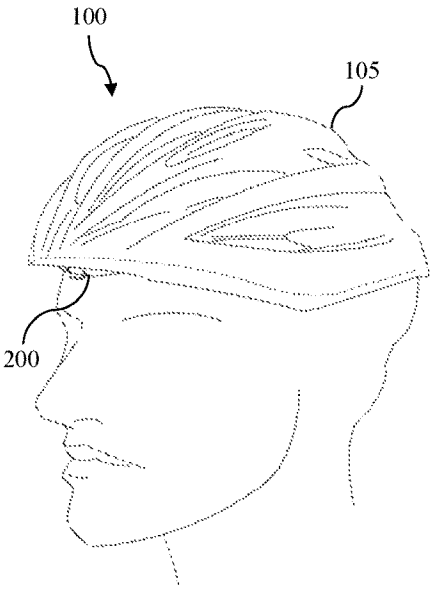
FIG. 1C is a perspective view of an illustration of the safety helmet worn by a user, wherein a brim of the safety helmet is in a retraced configuration, according to an example non-limiting embodiment.

Referring now to the Figures, FIGS. 1A-1C will be discussed together. FIG. 1A is a perspective view of an illustration of the safety helmet 100 worn by a wearer 101, wherein a brim 200 of the safety helmet is in a forward configuration, according to an example non-limiting embodiment. FIG. 1B is a perspective view of an illustration of the safety helmet worn by a user, wherein a brim of the safety helmet is in a downward configuration, according to an example non-limiting embodiment. FIG. 1C is a perspective view of an illustration of the safety helmet worn by a user, wherein a brim of the safety helmet is in a retraced configuration, according to an example non-limiting embodiment. The safety helmet includes a helmet shaped body 105 configured for wearing on a wearer's head and to expose a wearer's face. In the forward configuration as illustrated in FIG. 1A, the brim is such that such the first end 205 of the brim 200 extends outward beyond a forward facing surface 109 of the helmet shaped body. In the forward configuration, the brim of the helmet made block the sun rays from a wearer's eyes so that a wearer can safely ride. As will be further explained below, the present invention includes a pivoting element 500 (further explained below and illustrated with greater detail in FIGS. 5A-5C, for example) so that the brim can be moved from the forward configuration to a downward configuration (as illustrated in FIG. 1B). In the downward configuration, as illustrated in FIG. 1B, the brim is configured such that the first end of the brim does not extend beyond the forward facing surface 109 of the helmet. In the one configuration, the brim may act as a pair of sunglasses so that a user may use the brim as a pair of sunglasses. In other configurations, the downward configuration may not be necessary. The present invention may also include a bearing element 222 (further explained below and illustrated with greater detail in FIGS. 2C-2D, for example) that allows the brim to translate along a constrained path within the slot of the front section of the helmet shaped body so that the brim can move between the downward configuration and retracted configuration. In the retracted configuration, as illustrated in FIG. 1C, at least a substantial portion of the brim is configured to be received within the slot (further explained below). In the retracted configuration, a wearer can use the helmet without having a brim extend forward from the forward facing surface of the helmet.

Figures 2A, 2B:
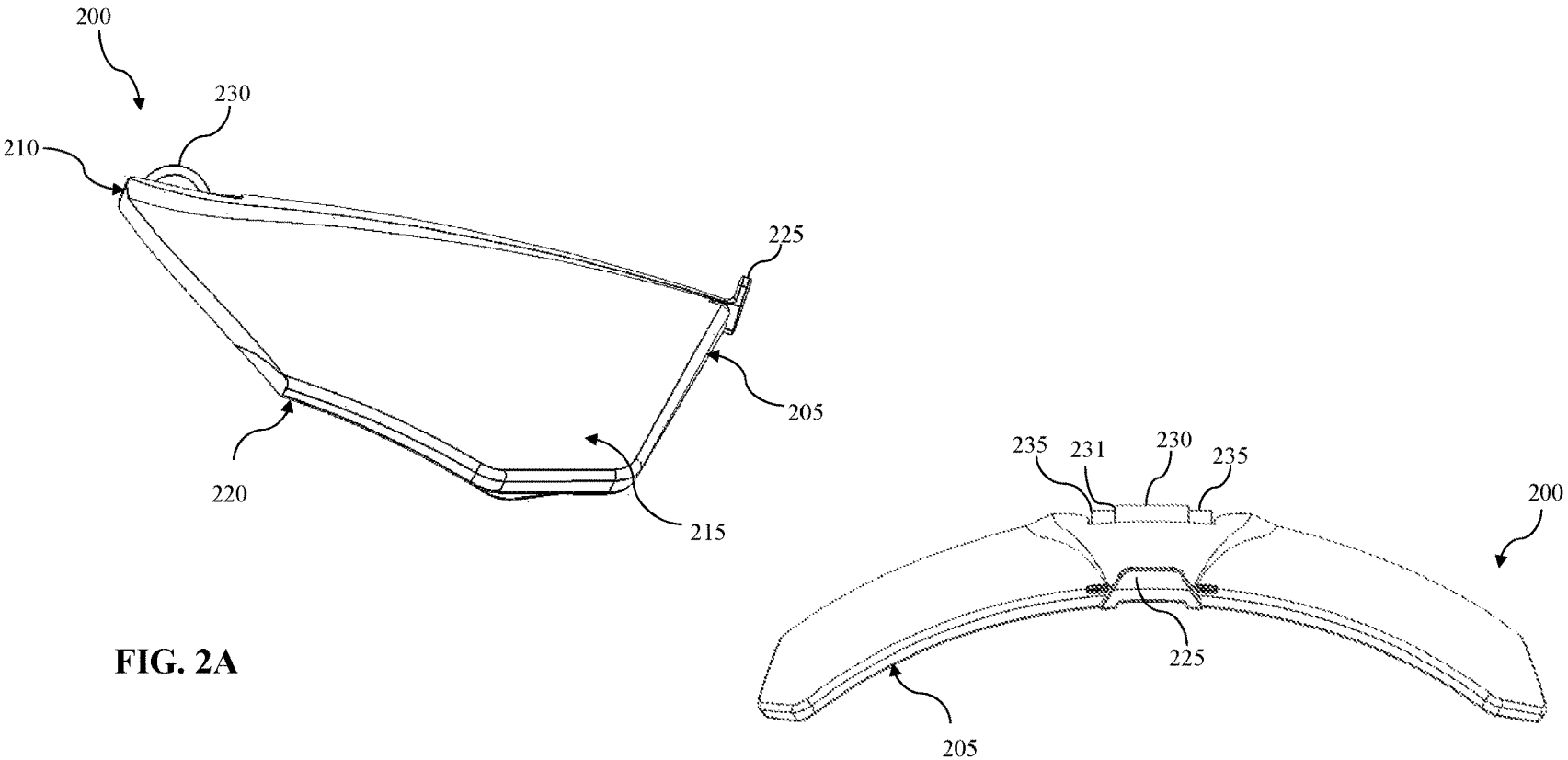
FIG. 2A is a side perspective view of an illustration of a brim of the safety helmet, according to an example non-limiting embodiment.
FIG. 2B is a front perspective view of an illustration of a brim of the safety helmet, according to an example non-limiting embodiment.
Figure 2D:
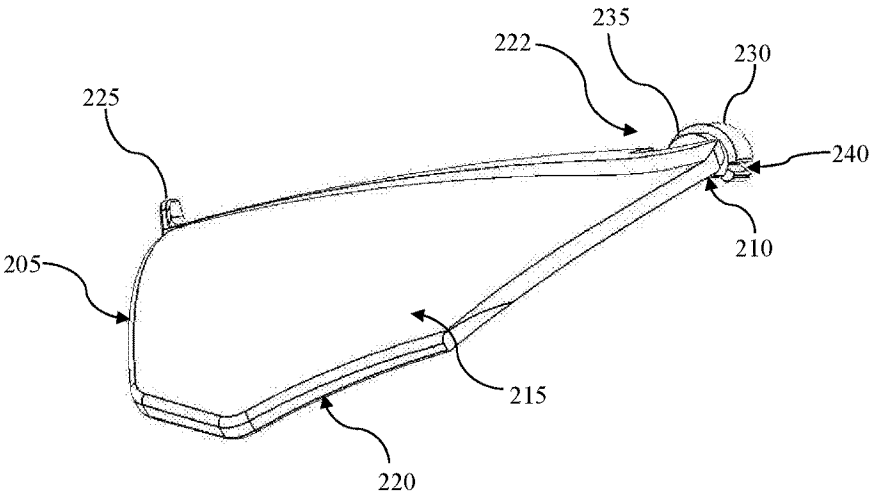
FIG. 2D is a second side perspective view of an illustration of a brim of the safety helmet, according to an example non-limiting embodiment.
Figure 2C:
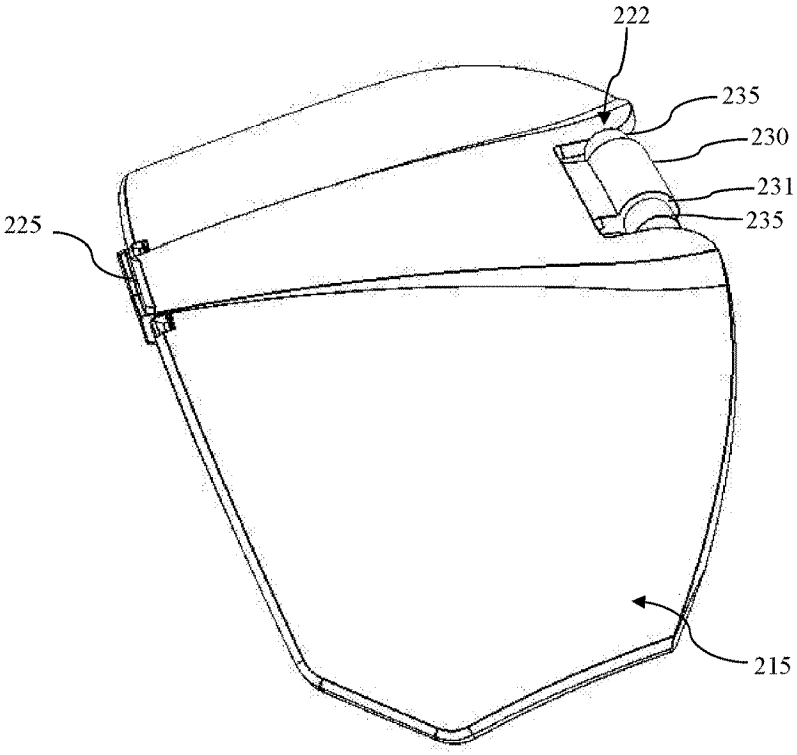
FIG. 2C is a top perspective view of an illustration of a brim of the safety helmet, according to an example non-limiting embodiment.

FIGS. 2A-2D will be discussed together. FIG. 2A is a side perspective view of an illustration of a brim 200 of the safety helmet, according to an example non-limiting embodiment. FIG. 2B is a front perspective view of an illustration of a brim of the safety helmet, according to an example non-limiting embodiment. FIG. 2C is a top perspective view of an illustration of a brim of the safety helmet, according to an example non-limiting embodiment. FIG. 2D is a second side perspective view of an illustration of a brim of the safety helmet, according to an example non-limiting embodiment. The brim has a first end 205 opposing a second end 210. The brim is configured to translate linearly within the slot 305 (further explained below and illustrated in FIGS. 3A-3B and 5A-5C, for example) between the retracted configuration (FIG. 1C) and a downward configuration (FIG. 1B). The brim can be substantially flat or curved planar shaped body. In the present embodiments, the brim is a curved shape, however other flat shapes may also be used and are within the spirit and scope of the present invention. When in the forward configuration, the first surface 215 of the brim faces upwards and the second surface 220 faces downwards. The first end 205 of the brim may comprise a tab 225 that extends perpendicular from the first end of the brim. In the present embodiment, the tab extends perpendicular upwards. However, in other embodiments, the tab may extend may extend perpendicular from above and below the first and second surface surfaces so that the tab extends partially downwards below the second surface of the tab and partially upwards below the first surface of the tab. In other embodiments, the tab may be partially angled so that the tab is not perpendicular. The tab allows the user to apply force to the brim in order to move between the retracted configuration, downward configuration and forward configurations.

A semi-cylindrical shaped body 230 may be presented on and proximate to the second end of the brim. A flanged and the 235 is positioned on each end of the cylindrical shaped body defining a shoulder 231 proximate to each end of the semi-cylindrical shaped body. As will be further explained below, the flanged ends are configured to interact with the hook elements (illustrated as 360 in FIGS. 3A-3B). As will be further explained below, the hook elements are configured to engage the flanged ends of the semi-cylindrical shaped body when the second end of the brim is proximate to the lip of the slot such that the brim can be pivoted from the downward configuration to the forward configuration. The semi-cylindrical shaped body is configured so that a portion proximate to the second surface defines a channel 410 (further explained below).

A groove 240 is positioned is presented along the semi-cylindrical shaped body. The groove is an elongated shaped groove that spans a portion of the semi-cylindrical shaped body. The groove is configured to catch an elongated ridge (365 in FIGS. 3A-3B) thereby defining the first locking element 505 and will be further explained below. As illustrated in FIG. 4C, a portion of the cylindrical shaped body may be hollow or define a channel 410. The channel is configured such that the semi-cylindrical shaped body can more easily pivot when moving between the downward configuration and for configuration. However, in other embodiments, the channel may not be required.

Figure 3B:
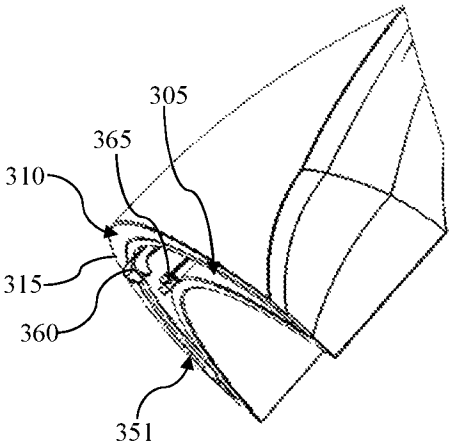
FIG. 3B is a cross-sectional side perspective view of an illustration of a portion of the safety helmet without the brim inside the helmet, according to an example non-limiting embodiment.
Figure 3A:
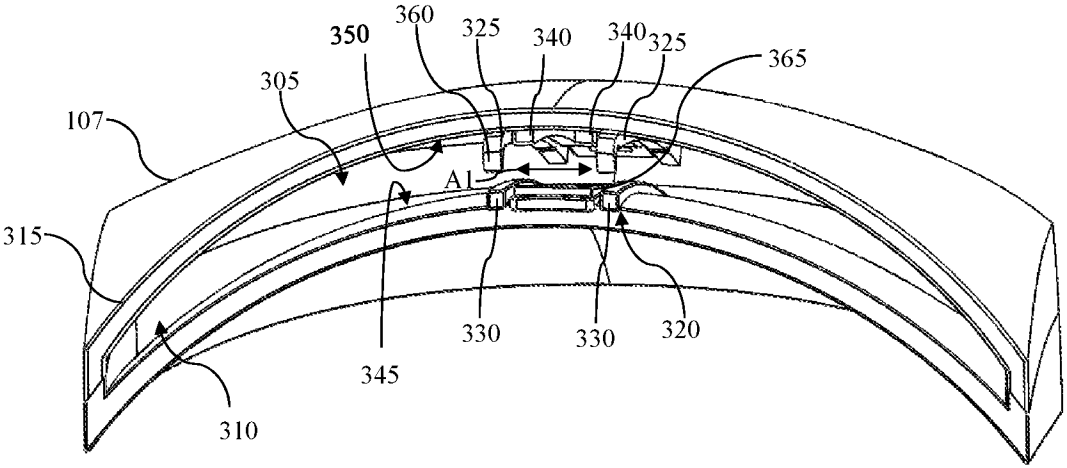
FIG. 3A is a cross-sectional front perspective view of an illustration of a portion of a first end of the safety helmet without the brim inside the helmet, according to an example non-limiting embodiment.
Figure 4B:
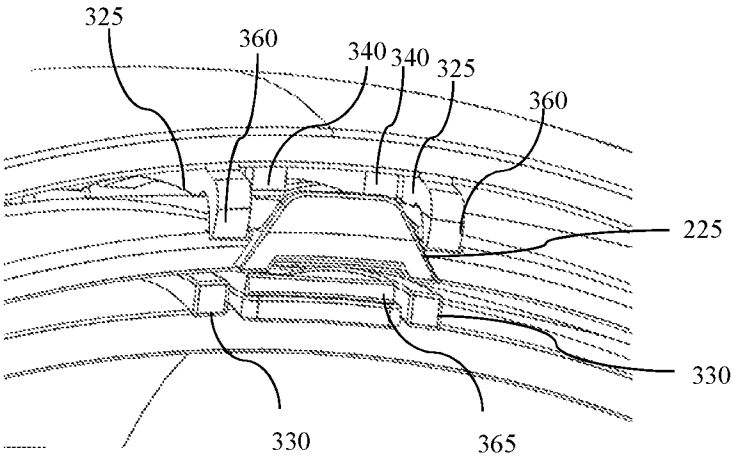
FIG. 4B is a zoomed-in cross-sectional front perspective view of an illustration of a portion of the safety helmet with the brim inside the helmet in a retracted configuration, according to an example non-limiting embodiment.
Figure 4A:
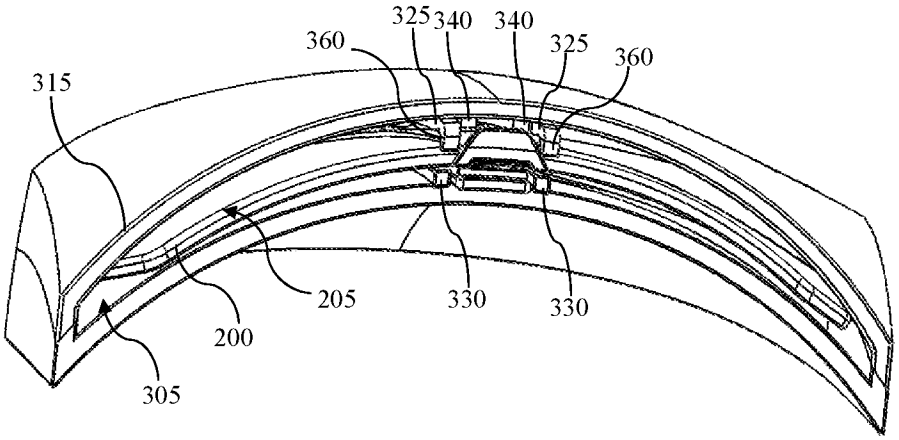
FIG. 4A is a cross-sectional front perspective view of an illustration of a portion of the safety helmet with the brim inside the helmet in a retracted configuration, according to an example non-limiting embodiment.
Figure 4C:
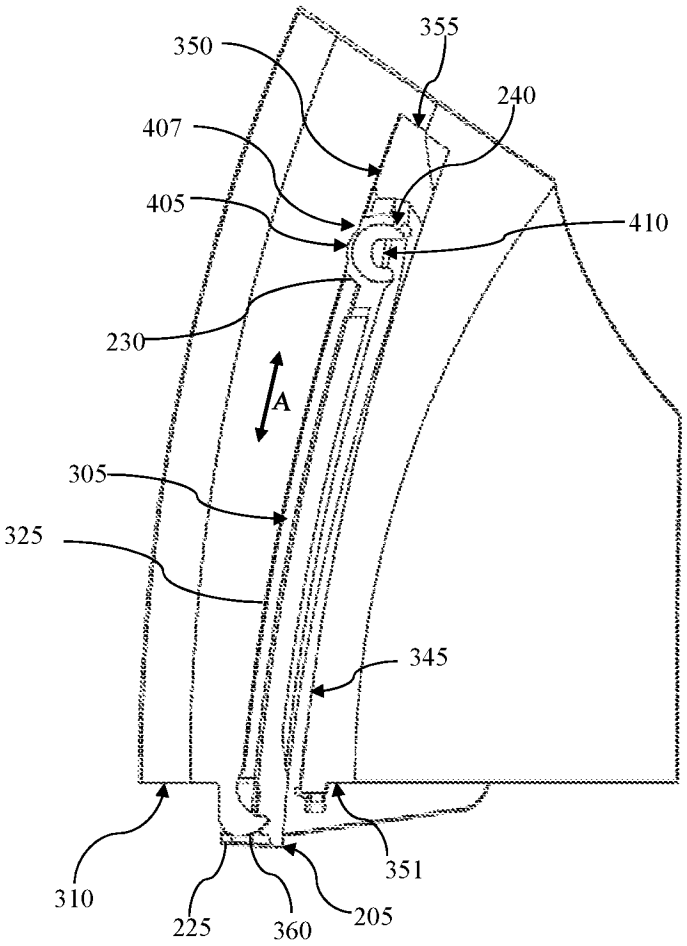
FIG. 4C is a cross-sectional side view of an illustration of a portion of the safety helmet with the brim inside the helmet in a retracted configuration, according to an example non-limiting embodiment.

Referring to FIGS. 3A-3D, FIG. 3A is a cross-sectional front perspective view of an illustration of the first end or front of the safety helmet without the brim inside the helmet. FIG. 3B is a cross-sectional side perspective view of an illustration of the safety helmet without the brim inside the helmet. FIG. 4A is a cross-sectional front perspective view of an illustration of the safety helmet with the brim 200 inside the helmet in a retracted configuration. FIG. 4B is a zoomed-in cross-sectional front perspective view of an illustration of the safety helmet with the brim inside the helmet in a retracted configuration. FIG. 4C is a cross-sectional side view of an illustration of the safety helmet with the brim inside the helmet in a retracted configuration. The helmet shaped body includes a downward facing surface or receiving surface 310. The downward facing surface faces downward when the helmet is worn by a user. However, in other embodiments, the receiving surface may be positioned so that the receiving surface faces in other directions, such as sideways, etc. The downward facing surface or receiving surface of the front section of the helmet shaped body includes a slot 305. The slot has a lip 315 that surrounds the slot. The slot has a first end 351 that is proximate to the lip and a second end 355 that is at the back end or closed end of the slot. The slot is configured such that when the brim is in the retracted configuration, the slot receives substantially all, or at least a substantial portion of the brim. A pair of hook elements 360 are positioned so that the hook elements protrude from the lip 315 from the first inside surface 350 of the slot. The hook elements may be positioned at the end of a pair of first rails 325.

The present invention may include a bearing element 222 that is configured to interact with a plurality of 320 opposing surfaces of the slot 305 so that the brim can more easily translate within the slot along a constrained path between the retracted configuration and the downward configuration. In one embodiment, the opposing surfaces of the slot may include at least a pair of first rails. The first rails may extend from proximate to the lip at the first end of the slot inwards into the slot and proximate to the second end 355 of the first inside surface 350 of the slot. In one embodiment, the pair of first rails are configured and positioned along the first inside surface 350 of the slot such that the bearing element of the second end 210 of the brim interacts with the rails. Essentially, the first rails may act as a guide rails so that some if not all of the lateral movement in the direction of line A1 (illustrated in FIG. 3A) within the slot is prevented.

In one embodiment, the bearing element 222 may comprise the semi-cylindrical shaped body 230 on the second end of the brim and the semi-cynical shaped body flanged ends 235. In other embodiments, the bearing element may also include portions of the second surface 220 or downward facing surface of the brim. In operation, when the brim is in the retracted configuration within the slot, the cylindrical shaped body is positioned between the pair of first rails 325 and the flanged ends are positioned below the rails such that the shoulders 231 of the cylindrical shaped body are prevented from lateral movement (in the direction of line A1 illustrated in FIG. 3A) within the slot by the first rails 325.

In other embodiments, the opposing surfaces of the slot may further comprise a pair of second rails 340 parallel to each other extending from proximate the left to proximate the second or back end 355 of the slot along the first inside surface 350 of the slot. The pair of second rails may be positioned between the pair of first rails. As illustrated in FIGS. 4A-4C, the second set of rails may be configured to oppose the bearing element provided by the sliding surfaces of the brim when the brim is translated within the slot. In other embodiments, the opposing surfaces of the slot may further comprise a pair of third rails 330 parallel to each other extending from proximate the second or back end 355 of the slot along the second inside surface 345 of the slot. The pair of second rails may be positioned between the pair of first rails. As illustrated in FIGS. 4A-4C, the second set of rails may be configured to oppose the bearing element provided by the sliding surfaces of the brim when the brim is translated within the slot.

Figure 5A:
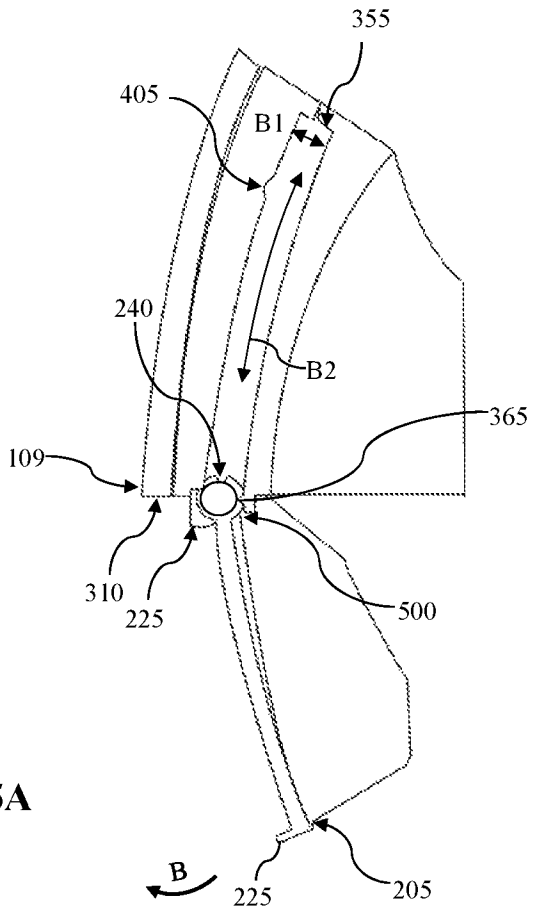
FIG. 5A is a cross-sectional side view of an illustration of a portion of the safety helmet with the brim in a downward configuration, according to an example non-limiting embodiment.

The pair of second rails 340 and pair of third rails 330 are positioned on opposing inside surfaces 350, 345 of the slot such that when the brim is within the slot, the second rails and third rails provide opposing surfaces such that the bearing element provided by the brim are restricted from forward and backward movement (illustrated as line B1 in FIG. 5A) and so that the bring can translate along the constrained path illustrated as line B2 in FIG. 5A).

Figure 5C:
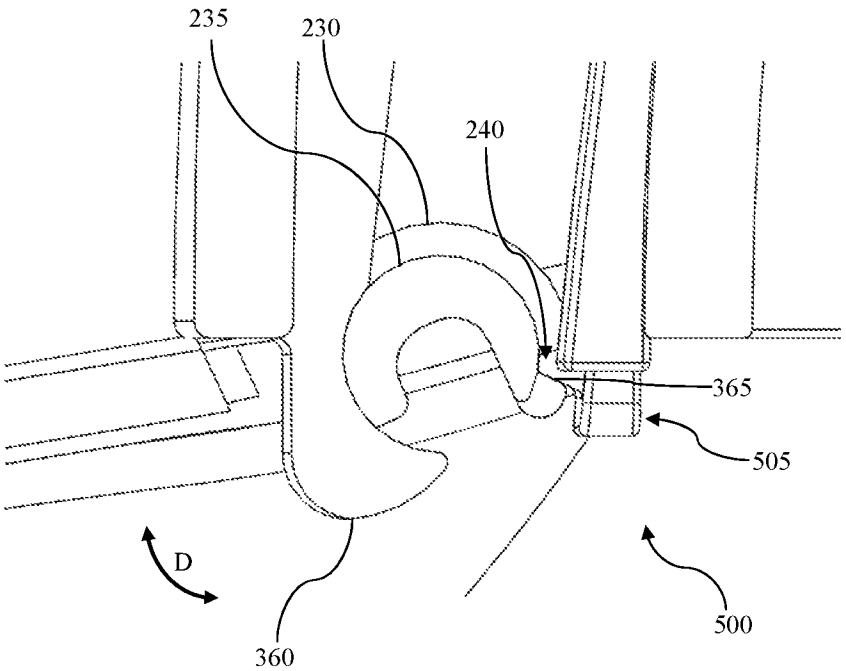
FIG. 5B is a cross-sectional side view of an illustration of a portion of the safety helmet with the brim in a forward configuration, according to an example non-limiting embodiment; and, FIG. 5C is a zoomed-in cross-sectional side view of an illustration of a pivoting element of the safety helmet with the brim in a forward configuration, according to an example non-limiting embodiment.
Figure 5B:
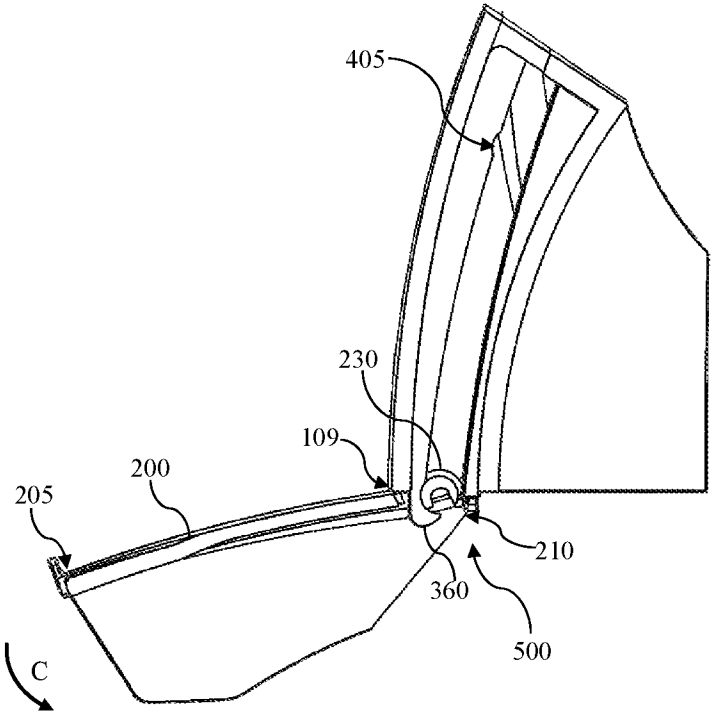

FIG. 5A is a cross-sectional side view of an illustration of the safety helmet with the brim in a downward configuration, according to an example non-limiting embodiment. FIG. 5B is a cross-sectional side view of an illustration of the safety helmet with the brim in a forward configuration, according to an example non-limiting embodiment. FIG. 5C is a zoomed-in cross-sectional side view of an illustration of the safety helmet with the brim in a forward configuration, according to an example non-limiting embodiment. FIGS. 5A-5C provide views of the pivoting element 500 in operation. The pivoting element is configured to pivotally couple the second end 255 of the brim proximate to the lip 315 of the slot 305. The pivoting element is configured to allow the brim to move or pivot between the downward configuration (as illustrated in FIG. 5A) and the forward configuration (as illustrated in FIGS. 5B-5C). In the present embodiment, the pivoting element 500 allows the brim to pivot about the pivot element in the direction of curved line D (illustrated in FIG. 5C). In the forward configuration the brim is configured such that the second end 210 of the brim is proximate to the downward facing surface 310 and such that the first end 205 of the brim extends outward beyond a forward facing surface 109 of the helmet shaped body.

In the present embodiment, the pivoting element comprises a first hook element 360 parallel to a second hook element 360 protruding downward from the lip 315. The hook elements are configured to engage flanged ends 235 of the semi-cylindrical shaped body on the second end 210 of the brim when the second end of the brim is proximate to the lip so that the brim can be pivoted from the downward configuration (as illustrated in FIG. 5A) to the forward configuration (as illustrated in FIGS. 5B and 5C). In operation, when in a retracted configuration as illustrated in FIG. 4C, a user would apply downward force to the tab such that the brim can move downward (in direction along line A) within the slot into the downward configuration (as illustrated in FIG. 5A). When translating within the slot, the bearing element 222 of the brim interacts with the opposing surfaces of the slot so that the brim 200 can translate within the slot along a constrained path. When in the downward configuration (as illustrated in FIG. 5A), the pivoting element 500 can be used to pivot the brim from the downward configuration to the forward configuration (as illustrated in FIGS. 5B and 5C). When moving between the downward configuration and forward configuration, the hook elements 360 engage the flanged ends of the cylindrical shaped body 230 of the brim. In operation, to move from the downward configuration (as illustrated in FIG. 5A) to the forward configuration, a user would apply force to the brim, such that the first end 205 of the brim pivots so that the first end of the brim extends beyond the forward facing surface 109 of the helmet. While the embodiment discloses a means for pivoting the brim, it is understood that other methods of moving the first end of the brim beyond the forward facing surface 109 of the helmet may also be used and are within the spirit and scope of the present invention.

The safety helmet may also include a first locking element 505. The first locking element allows the brim to remain in the forward configuration. The first locking element comprises the groove 240 disposed along the semi-cylindrical shaped body. The groove is configured to catch the elongated ridge 365 of the slot when the first end of the brim is rotated from the downward configuration to the forward configuration. In operation, when in the downward configuration, a user would apply force to the brim such that the semi-cylindrical shaped body is rotated such that the groove 240 of the semi-cylindrical shaped body is positioned such that the elongated ridge 365 is caught in the groove. As a result, the hook elements and the elongated ridge prevents the brim from pivoting in the direction of line C. In order to release the first locking element, a user would apply force so that the semi-cylindrical shaped body is moved such that the groove decouples from the elongated shaped ridge thereby allowing the first end of the brim 205 to pivoted back into the downward configuration.

The safety helmet may also comprise a second locking element 407. The second locking element is configured to maintain the brim in the retracted configuration when the brim is received within the slot. In the present embodiments, the second locking element comprises a detent 405 or depression proximate to the second end 355 of the slot. The detent is configured such that when the brim is in the fully retracted position (as illustrated in FIG. 4C) the outer surface of the cylindrical shaped body 230 is received by the depression or detent. In operation, to move from the downward configuration (as illustrated in FIG. 5A) to the fully retracted configuration as illustrated in FIG. 4C, a user will apply an upward force on the brim in the direction of line A to move the second end 210 of the brim into the second end 355 of the slot. As the second end of the brim enters the second end of the slot, the outer surface of the semi-cylindrical shaped body facing the depression, enters into the depression. The dimension of the slot, dimension of the semi-cylindrical shaped body, and material used to form the slot and the cylindrical shaped body is such that a snug fit is provided. Additionally, as the semi-cylindrical shaped body enters into the detent, the detent is able to catch and retain the semi-cylindrical shaped body in the depression. In other embodiments, other second locking elements may also be used to retain the brim in a retracted configuration. The embodiments may include a clasp, bar, or other elements that spans the opening of the slot so that the brim can be retained in the retracted configuration.

In other embodiments (not illustrated), the present invention may also include an apparatus for attaching to a safety helmet. The apparatus may include a curved shaped body configured for coupling to a front part of a safety helmet. This curved shaped body can essentially be attached or coupled to the outward facing surface of the fort front portion of the helmet. The curved shaped body may be coupled via hook and loop fastener, snaps, etc. The curved shaped body may comprise a slot having a lip presented on a downward facing surface of a front section of the curved shaped body. It will also include a brim having a first end opposing a second end, the brim configured to translate linearly within the slot of the curve shaped body. Similar to the other embodiments disclosed herein, at least a substantial portion of the brim is configured to be received within the slot when the brim in a retracted configuration. A pivoting element may be included with the apparatus and configured to pivotally couple the second end of the brim proximate to the lip of the slot. The pivoting element may be configured to allow the brim to move between the retracted configuration and a forward configuration. In the forward configuration the brim is configured such that the second end of the brim is proximate to the downward facing surface and the first end of the brim extends outward beyond a forward facing surface of the curved shaped body. The curved shaped body may also include a lower locking element configured to maintain the brim in the forward configuration.

The material helmet shaped body may comprise material that is configured to provide adequate safety for a wearer. The outward facing surface may comprise a shell that is able to adequately absorb the force received from striking object. In certain embodiments, the safety helmet may also include chin straps so that the helmet can be secured tightly to the head of a user. In certain embodiments, the brim may be made of transparent materials so that the user can see through the brim when the brim is positioned in the downward configuration. In other embodiments, the brim may comprise nontransparent materials. The various components of the present invention may comprise material that is injection molded or extruded. Additionally, the brim may also comprise softer materials that may be more easily bent or manipulated, such as cloth, paper, soft plastic or polymeric materials, etc. Additionally, in the present embodiment, the materials used to make the present invention may comprise polymeric materials. In one non-limiting embodiment, the visor can be made from a hard material such as a plastic material or the like, the size of a brim is limited to the extent that it can be accommodated into the slot.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A safety helmet comprising:

a helmet shaped body configured for wearing on a wearer's head and to expose the wearer's face;

a slot having a lip presented on a downward facing surface of a front section of the helmet shaped body;

a brim having a first end opposing a second end, the brim configured to translate linearly within the slot between a retracted configuration and a downward configuration, wherein when in the retracted configuration a majority of the brim is received within the slot, and wherein in the downward configuration the brim is configured such that the second end of the brim is proximate to the downward facing surface and the first end of the brim does not extend beyond a forward facing surface of the helmet;

a pivoting element configured to pivotally couple the second end of the brim proximate to the lip of the slot, the pivoting element configured to allow the brim to move between the downward configuration and a forward configuration, and wherein in the forward configuration the brim is configured such that the second end of the brim is proximate to the downward facing surface and the first end of the brim extends outward beyond the forward facing surface of the helmet shaped body; and a first locking element configured to maintain the brim in the forward configuration.

2. The safety helmet of claim 1, wherein the pivoting element comprises a first hook element parallel to a second hook element protruding from the lip, the hook elements configured to engage flanged ends of a semi-cylindrical shaped body on the second end of the brim when the second end of the brim is proximate to the lip such that the brim can be pivoted from the downward configuration to the forward configuration.

3. The safety helmet of claim 1, wherein a second locking element comprises a detent proximate to a second end of the slot configured to catch a semi-cylindrical shaped body.

4. The safety helmet of claim 1, wherein the first locking element comprises a groove presented along a semi-cylindrical shaped body, the groove configured to catch an elongated ridge proximate the lip when the brim is moved from the downward configuration to the forward configuration.

5. The safety helmet of claim 1, wherein the first end of the brim comprises a tab extending perpendicular from a first surface of the brim.

6. A safety helmet comprising:

a helmet shaped body configured for wearing on a wearer's head and to expose the wearer's face;

a slot having a lip presented on a downward facing surface of a front section of the helmet shaped body;

a brim having a first end opposing a second end, the brim configured to translate linearly within the slot between a retracted configuration and a downward configuration, wherein when in the retracted configuration a majority of the brim is received within the slot, and wherein in the downward configuration the brim is configured such that the second end of the brim is proximate to the downward facing surface and the first end of the brim does not extend beyond a forward facing surface of the helmet;

a bearing element configured to interact with a plurality of opposing surfaces of the slot so that the brim can translate within the slot along a constrained path between the retracted configuration and the downward configuration;

a pivoting element configured to pivotally couple the second end of the brim proximate to the lip of the slot, the pivoting element configured to allow the brim to move between the downward configuration and a forward configuration, and wherein in the forward configuration the brim is configured such that the second end of the brim is proximate to the downward facing surface and the first end of the brim extends outward beyond the forward facing surface of the helmet shaped body;

a first locking element configured to maintain the brim in the forward configuration; and a second locking element configured to maintain the brim in the retracted configuration when the brim is received within the slot.

7. The safety helmet of claim 6, wherein the bearing element comprises a semi-cylindrical shaped body on the second end of the brim, the semi-cylindrical shaped body having opposing ends, each of the opposing ends having a respective flange.

8. The safety helmet of claim 7, wherein the opposing surfaces of the slot comprise at least a pair of first rails parallel to each other, the pair of first rails extending from proximate to the lip at a first end of the slot to proximate a second end of the slot along a first inside surface of the slot.

9. The safety helmet of claim 8, wherein the opposing surfaces of the slot further comprise a pair of second rails parallel to each other and positioned between the pair of first rails, and a pair of third rails parallel to each other extending from proximate the lip to proximate the second end of the slot along a second inside surface of the slot.

10. The safety helmet of claim 9, wherein the pivoting element comprises a first hook element parallel to a second hook element protruding from the lip, the hook elements configured to engage the flanged ends of the semi-cylindrical shaped body when the second end of the brim is proximate to the lip such that the brim can be pivoted from the downward configuration to the forward configuration.

11. The safety helmet of claim 10, wherein the first locking element comprises a groove presented along the semi-cylindrical shaped body, the groove configured to catch an elongated ridge proximate the lip when the brim is moved from the downward configuration to the forward configuration.

12. The safety helmet of claim 11, wherein the second locking element comprises a detent proximate to a second end of the slot configured to catch the semi-cylindrical shaped body.

13. The safety helmet of claim 12, wherein the first end of the brim comprises a tab extending perpendicular from a first surface of the brim.

14. A safety helmet comprising:

a helmet shaped body configured for wearing on a wearer's head and to expose the wearer's face;

a slot having a lip presented on a receiving surface of a front section of the helmet shaped body;

a brim having a first end opposing a second end, the brim configured to translate linearly within the slot between a downward configuration and a retracted configuration, and wherein a majority of the brim is received within the slot when the brim is in the retracted configuration;

a pivoting element configured to pivotally couple the second end of the brim proximate to the lip of the slot, the pivoting element configured to allow the brim to move between the downward configuration and a forward configuration, wherein in the forward configuration the brim is configured such that the second end of the brim is proximate to the receiving surface, and the first end of the brim extends outward beyond a forward facing surface of the helmet shaped body; and a first locking element configured to maintain the brim in the forward configuration.

15. The safety helmet of claim 14, wherein the first locking element comprises a groove presented along a semi-cylindrical shaped body, the groove configured to catch an elongated ridge proximate the lip of the slot when the brim is moved from the downward configuration to the forward configuration.

16. The safety helmet of claim 14, wherein the first end of the brim comprises a tab extending perpendicular from a first surface of the brim.

17. The safety helmet of claim 14, wherein the pivoting element comprises at least one hook element protruding from the lip, the hook element configured to engage at least one flanged end of a semi-cylindrical shaped body when the second end of the brim is proximate to the lip such that the brim can be pivoted from the downward configuration to the forward configuration.

18. The safety helmet of claim 14, wherein the brim includes a bearing element configured to interact with a plurality of opposing surfaces of the slot so that the brim can translate within the slot along a constrained path.

19. The safety helmet of claim 18, wherein the bearing element of the brim comprises a semi-cylindrical shaped body on the second end of the brim, the semi-cylindrical shaped body having opposing ends, each of the opposing ends having a respective flange.

20. The safety helmet of claim 19, wherein the plurality of opposing surfaces comprises at least a pair of first rails parallel to each other, the pair of first rails extending from proximate the lip at a first end of the slot to proximate a second end of the slot along a first inside surface of the slot.

* * * * *